US010459385B2

(12) United States Patent
Yagi et al.

(10) Patent No.: US 10,459,385 B2
(45) Date of Patent: Oct. 29, 2019

(54) FIXING DEVICE AND IMAGE FORMING APPARATUS

(71) Applicant: FUJI XEROX Co., Ltd., Tokyo (JP)

(72) Inventors: Motoyuki Yagi, Kanagawa (JP); Noriaki Kishi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/166,549

(22) Filed: Oct. 22, 2018

(65) Prior Publication Data

US 2019/0219956 A1 Jul. 18, 2019

(30) Foreign Application Priority Data

Jan. 12, 2018 (JP) ..... 2018-003504

(51) Int. Cl.
*G03G 15/20* (2006.01)

(52) U.S. Cl.
CPC . *G03G 15/2064* (2013.01); *G03G 2215/2016* (2013.01)

(58) Field of Classification Search
CPC ..... G03G 15/2017; G03G 15/2064; G03G 2215/2009
See application file for complete search history.

(56) References Cited

U.S. PATENT DOCUMENTS 7,260,353 B2 * 8/2007 Takemura ..... G03G 15/206 399/329

FOREIGN PATENT DOCUMENTS

JP 10-186911 A 7/1998
JP 2008-070913 A 3/2008

* cited by examiner

*Primary Examiner* — Erika J Villaluna
(74) *Attorney, Agent, or Firm* — Sughrue Mion, PLLC

(57) ABSTRACT

A fixing device includes a first pressing member that is heated and that presses a recording medium moving along a recording medium transport path; a second pressing member that is disposed opposite the first pressing member across the recording medium transport path and presses the recording medium, the second pressing member including an opposing portion opposing the first pressing member, the opposing portion having, at a part, a pressed portion pressed against the first pressing member; and a heat receiver that is disposed to oppose an upstream portion of the opposing portion, the upstream portion of the opposing portion being located upstream of the pressed portion in a direction in which the recording medium moves, the heat receiver being disposed upstream of the recording medium transport path and receiving heat from the first pressing member.

11 Claims, 5 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2018-003504 filed Jan. 12, 2018.

BACKGROUND (i) Technical Field

The present disclosure relates to a fixing device and an image forming apparatus.

(ii) Related Art

Japanese Unexamined Patent Application Publication No. 10-186911 discloses a fixing device that fixes an unfixed image on a recording medium onto the recording medium by causing the recording medium to pass through a fixing nip formed by a pressing member and a fixing member including a heating unit coming into contact with each other with pressure.

Japanese Unexamined Patent Application Publication No. 2008-70913 discloses a structure of a fixing roller including three separate pressing members, around all of which a belt is wound and which press the belt from the back surface, to distribute appropriate pressing forces at three portions.

SUMMARY

A fixing device that fixes an image onto a recording medium and includes a heat receiver, which receives heat from a heat source, to reduce heat transfer to the outside enhances its efficiency of heating the recording medium. The heat receiver, on the other hand, may change the fixing properties of the fixing device.

The present disclosure aims to provide a fixing device that enhances the efficiency of heating a recording medium without changing the fixing properties of fixing an image to the recording medium, compared to the structure including a heat receiver, which receives heat, at a portion at which the heat receiver is more likely to change the fixing properties.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device that includes a first pressing member that is heated and that presses a recording medium moving along a recording medium transport path; a second pressing member that is disposed opposite the first pressing member across the recording medium transport path and presses the recording medium, the second pressing member including an opposing portion opposing the first pressing member, the opposing portion having, at a part, a pressed portion pressed against the first pressing member; and a heat receiver that is disposed to oppose an upstream portion of the opposing portion, the upstream portion of the opposing portion being located upstream of the pressed portion in a direction in which the recording medium moves, the heat receiver being disposed upstream of the recording medium transport path and receiving heat from the first pressing member.

BRIEF DESCRIPTION OF THE DRAWINGS

Exemplary embodiments of the present disclosure will be described in detail based on the following figures, wherein.

DETAILED DESCRIPTION

An exemplary embodiment of the present disclosure is described below with reference to the appended drawings.

Figure 1:
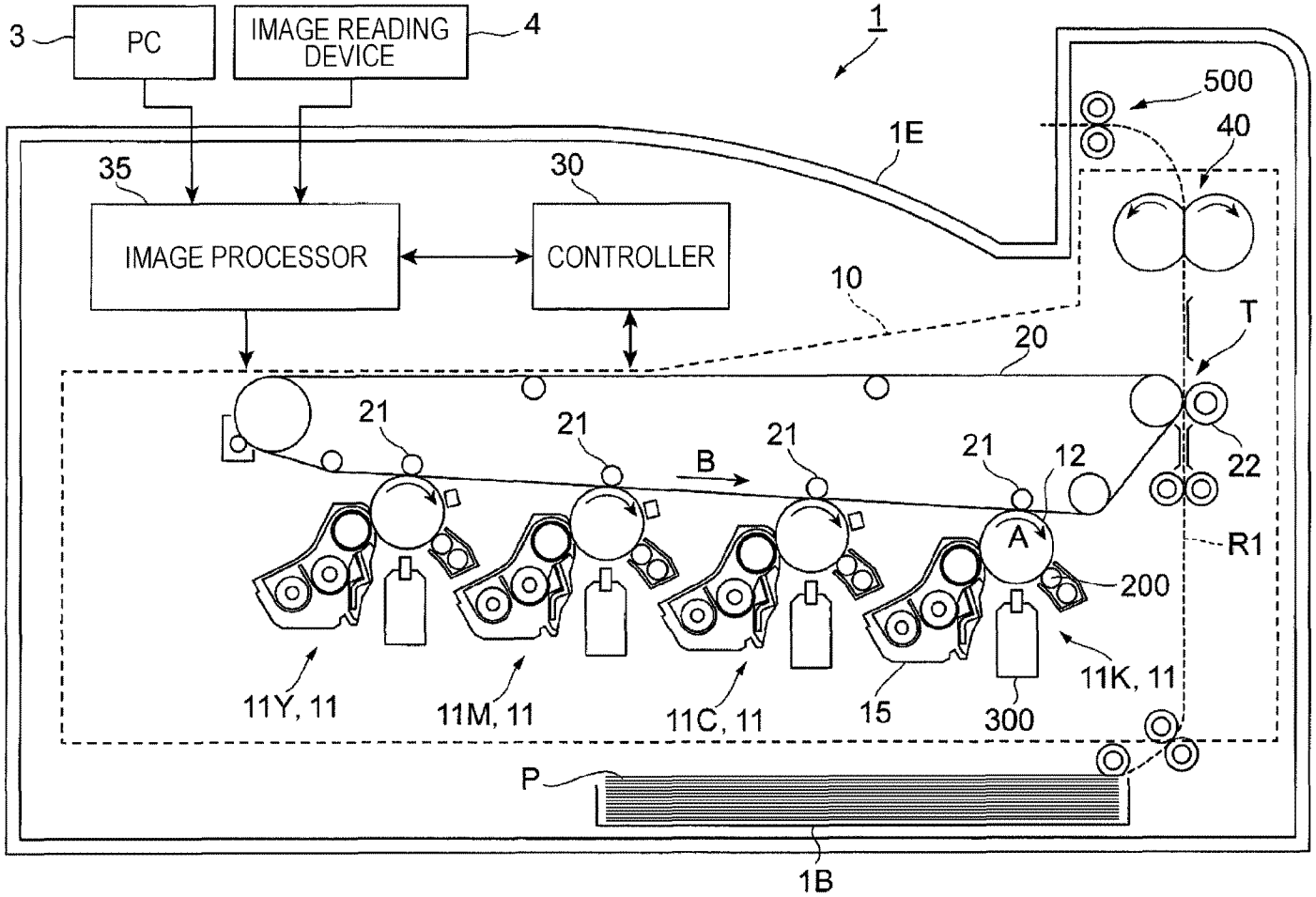
FIG. 1 illustrates an entire structure of an image forming apparatus.

FIG. 1 illustrates an entire structure of an image forming apparatus 1.

The image forming apparatus 1 is a so-called tandem color printer. The image forming apparatus 1 includes an image forming portion 10, which is an example of an image forming member.

The image forming apparatus 1 also includes a controller 30 and an image processor 35.

The image forming portion 10 forms images on sheets P, which are an example of a recording medium, on the basis of image data of different colors.

The controller 30 controls functional units of the image forming apparatus 1.

The image processor 35 performs image processing on image data from, for example, a personal computer (PC) 3 or an image reading device 4.

The image forming portion 10 includes four image forming units 11Y, 11M, 11C, and 11K (also simply referred to as "image forming units 11", collectively, below), arranged side by side at uniform intervals.

The image forming units 11 have the same structure except for toner contained in respective developing devices 15 (described later). The image forming units 11 respectively form toner images (images) of yellow (Y), magenta (M), cyan (C), and black (K).

Each image forming unit 11 includes a photoconductor drum 12, a charging device 200, which charges the photoconductor drum 12 with electricity, and an LED print head (LPH) 300, which exposes the photoconductor drum 12 to light.

The photoconductor drum 12 is charged with electricity by the charging device 200. The photoconductor drum 12 is also exposed to light by the LPH 300 to have an electrostatic latent image formed thereon.

Each image forming unit 11 includes a developing device 15, which develops the electrostatic latent image on the photoconductor drum 12, and a cleaner (not illustrated) that cleans the surface of the photoconductor drum 12.

The image forming portion 10 also includes an intermediate transfer belt 20, to which toner images of different colors formed on the respective photoconductor drums 12 are transferred, and first transfer rollers 21, which sequentially transfer (first-transfer) the toner images of different colors formed on the respective photoconductor drums 12 to the intermediate transfer belt 20.

The image forming portion 10 also includes a second transfer roller 22, which collectively transfers (second-transfers) the toner images transferred onto the intermediate transfer belt 20 to a sheet P, and a fixing device 40, which fixes the toner images transferred to the sheet P onto the sheet P.

In the image forming apparatus 1, the image processor 35 performs image processing on image data from the PC 3 or the image reading device 4, and supplies the image data subjected to image processing to the image forming units 11.

Then, for example, in the image forming unit 11K for black (K), the photoconductor drum 12 is, while rotating in the direction of arrow A, charged with electricity by the charging device 200 and exposed by the LPH 300 to light based on the image data transmitted from the image processor 35.

Thus, the photoconductor drum 12 has an electrostatic latent image for a black (K) image formed thereon. The electrostatic latent image formed on the photoconductor drum 12 is developed by the developing device 15 into a black (K) toner image on the photoconductor drum 12.

Similarly, the image forming units 11Y, 11M, and 11C respectively form toner images of yellow (Y), magenta (M), and cyan (C).

The toner images of respective colors formed by the image forming units 11 are sequentially electrostatically attracted to the intermediate transfer belt 20 moving in the direction of arrow B by the first transfer rollers 21. Thus, the intermediate transfer belt 20 has a toner image formed thereon by superposing the toner images of respective colors.

The toner image formed on the intermediate transfer belt 20 is transported by the movement of the intermediate transfer belt 20 to a portion (second transfer portion T) at which the second transfer roller 22 is located. Concurrently with the toner image being transported to the second transfer portion T, a sheet P is fed from a sheet container 1B to the second transfer portion T.

At the second transfer portion T, the transfer electric field formed by the second transfer roller 22 electrostatically collectively transfers the toner image on the intermediate transfer belt 20 to the sheet P transported thereto.

Thereafter, the sheet P to which the toner image has been electrostatically transferred is separated from the intermediate transfer belt 20 and transported to the fixing device 40.

The fixing device 40 presses and heats the sheet P. Thus, the toner image on the sheet P is fixed to the sheet P. The sheet P subjected to fixing is transported to a sheet receiver 1E by discharging rollers 500.

Figure 2:
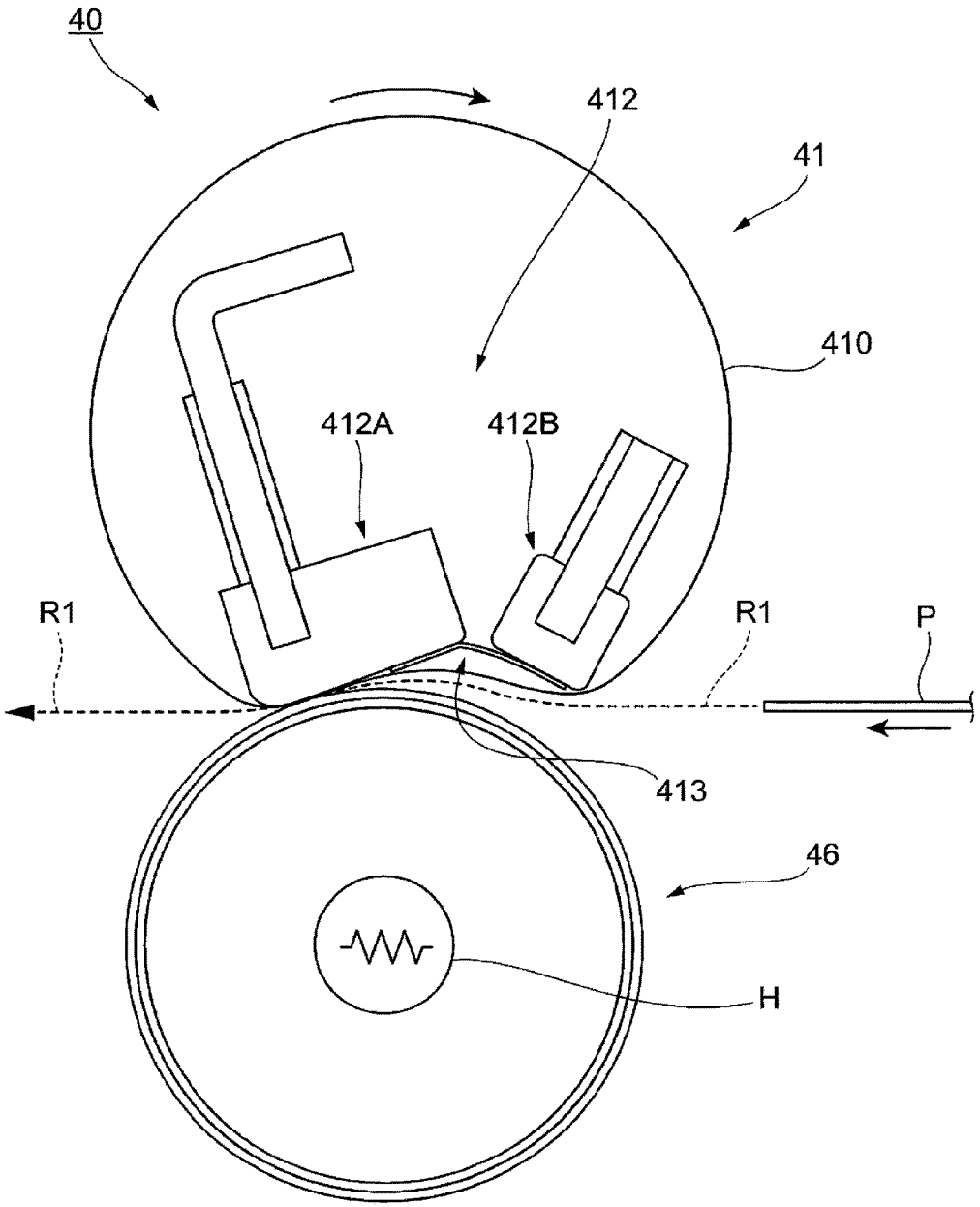
FIG. 2 illustrates a structure of a fixing device.

FIG. 2 illustrates a structure of the fixing device 40.

The fixing device 40 includes a fixing belt module 41 including a fixing belt 410. The fixing device 40 includes a pressing roller 46, which is pressed against the fixing belt module 41.

The fixing belt module 41 includes the fixing belt 410, which comes into contact with a sheet P transported thereto from the right in the drawing. The fixing belt 410 is endless and circularly moves clockwise in the drawing. The fixing belt 410 includes, for example, a release layer that is located outermost and comes into contact with the sheet P, an elastic layer that is located adjacent to and on the inner side of the release layer, and a base layer that supports the elastic layer.

The fixing belt 410 comes into contact with the sheet P transported thereto from the right in the drawing along a sheet transport path R1. The portion of the fixing belt 410 that is in contact with the sheet P moves together with the sheet P. In addition, the fixing belt 410 holds the sheet P together with the pressing roller 46 between themselves to press and heat the sheet P.

The fixing belt module 41 also includes a pressing unit 412 on the inner side of the fixing belt 410. The pressing unit 412 is an example of a second pressing member that presses the sheet P with the fixing belt 410 interposed therebetween.

The pressing unit 412 includes a pad-shaped downstream contact member 412A.

The downstream contact member 412A is located downstream in the direction in which the sheet P moves, and comes into contact with the internal circumferential surface of the fixing belt 410.

The downstream contact member 412A has a portion (portion downstream in the direction in which the sheet P moves) pressed against the pressing roller 46 with the fixing belt 410 interposed therebetween.

The pad-shaped upstream contact member 412B, which comes into contact with the internal circumferential surface of the fixing belt 410, is located upstream of the downstream contact member 412A in the direction in which the sheet P moves.

The upstream contact member 412B is disposed apart from the pressing roller 46. In the present exemplary embodiment, the upstream contact member 412B is not pressed against the pressing roller 46.

In the present exemplary embodiment, the downstream contact member 412A and the upstream contact member 412B are spaced apart from each other.

The pressing unit 412 also includes a support member (support frame), not illustrated. The support member supports both the downstream contact member 412A and the upstream contact member 412B.

The fixing belt module 41 includes a heat receiver 413 between the pressing unit 412 and the internal circumference of the fixing belt 410. The heat receiver 413 receives heat from the pressing roller 46.

The fixing belt module 41 also includes a sheet member (not illustrated) between the pressing unit 412 and the internal circumferential surface of the fixing belt 410 at a portion closer to the fixing belt 410 than is the heat receiver 413. The sheet member facilitates sliding of the pressing unit 412 and the internal circumferential surface of the fixing belt 410 relative to each other.

The pressing roller 46, which is an example of a first pressing member, is formed of a metal-made hollow cylinder having a surface coated with a resin material.

The pressing roller 46 receives a driving force from a motor (not illustrated) to rotate counterclockwise in the drawing. When the pressing roller 46 rotates counterclockwise, the fixing belt 410 receives a driving force from the pressing roller 46 to rotate clockwise.

A heat source H is disposed inside the pressing roller 46. In the present exemplary embodiment, the heat source H heats the pressing roller 46.

Here, the pressing roller 46 is disposed on one side of the sheet transport path R1 (recording medium transport path) to press, from this side, the sheet P moving along the sheet transport path R1.

On the other hand, the fixing belt module 41 is disposed on the opposite side of the sheet transport path R1 from the pressing roller 46 is disposed. The fixing belt module 41 presses, from this side, the sheet P moving along the sheet transport path R1.

The present exemplary embodiment has described, for example, a case where rotatable members (the fixing belt 410 and the pressing roller 46) are disposed on opposing sides across the sheet transport path R1.

Here, one or both of the members disposed on both sides may be non-rotatable members such as pad-shaped members, instead of the rotatable members.

Figure 3:
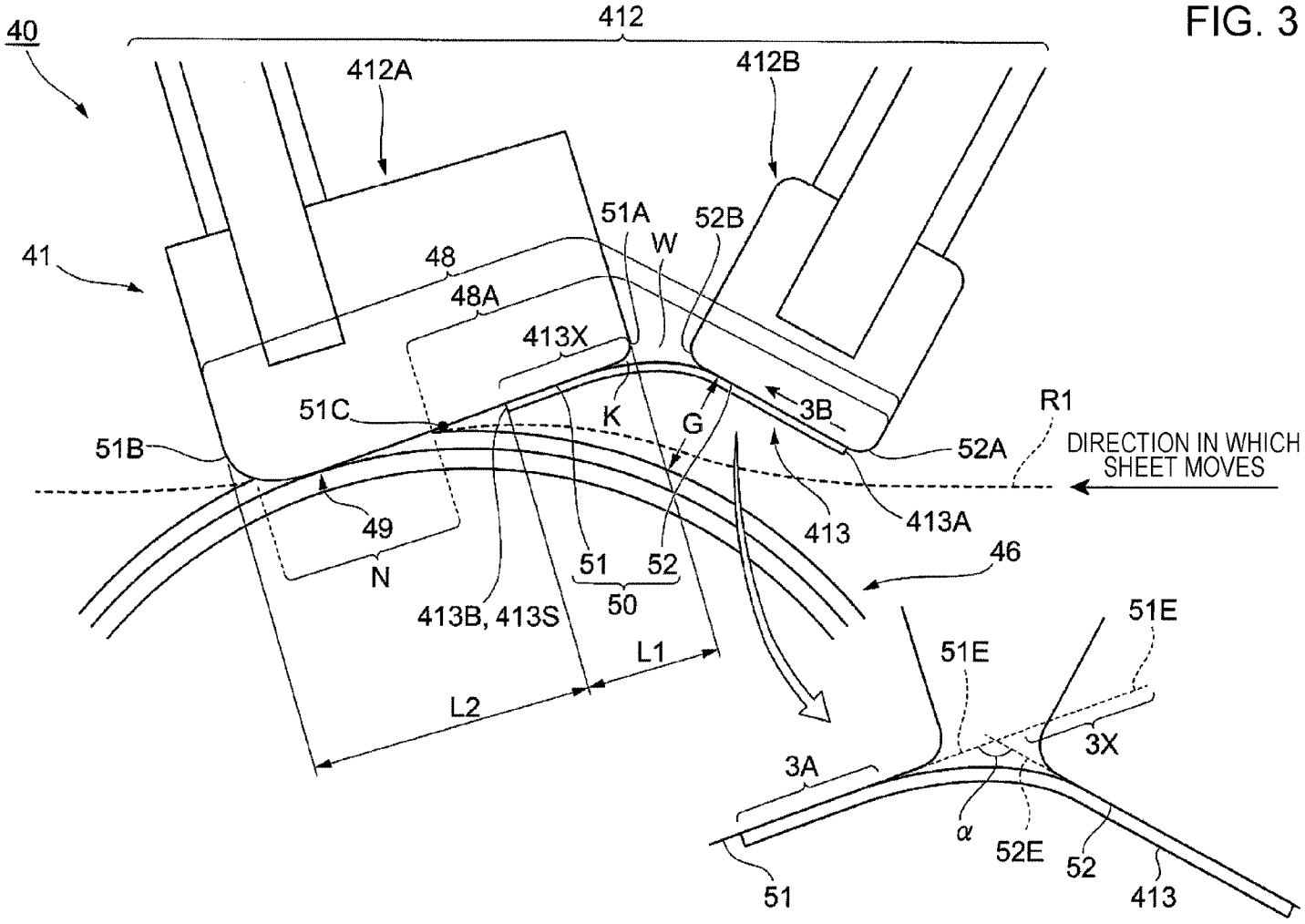
FIG. 3 is an enlarged view of a contact portion between a fixing belt module and a pressing roller.

FIG. 3 is an enlarged view of a contact portion between the fixing belt module 41 and the pressing roller 46. FIG. 3 omits an illustration of the fixing belt 410.

As illustrated in FIG. 3, the pressing unit 412 of the fixing belt module 41 includes an opposing portion 48, which opposes the pressing roller 46.

In the present exemplary embodiment, instead of the entirety of the opposing portion 48 being pressed against the pressing roller 46, a pressed portion 49, which is a portion of the opposing portion 48, is pressed against the pressing roller 46.

More specifically, a downstream portion of the opposing portion 48 in the direction in which the sheet P moves is pressed against the pressing roller 46.

In the present exemplary embodiment, the pressed portion 49 is pressed against the pressing roller 46 and forms a nip area N in which the sheet P is pressed and heated.

The opposing portion 48 according to the present exemplary embodiment includes an upstream portion 48A, disposed upstream of the pressed portion 49 in the direction in which the sheet P moves.

In the present exemplary embodiment, a heat receiver 413 is disposed at a portion opposing the upstream portion 48A.

More specifically, in the present exemplary embodiment, the heat receiver 413 is disposed upstream of the pressed portion 49 in the direction in which the sheet P moves.

The heat receiver 413 is disposed to oppose the upstream portion 48A of the opposing portion 48, disposed upstream of the pressed portion 49.

The heat receiver 413 is disposed closer to the upstream portion 48A than the sheet transport path R1. In other words, the heat receiver 413 is disposed closer to the pressing unit 412 than the sheet transport path R1.

The heat receiver 413 also includes an upstream end portion 413A, upstream in the direction in which the sheet P moves, and a downstream end portion 413B, downstream in the direction in which the sheet P moves. The upstream end portion 413A and the downstream end portion 413B are disposed along the sheet transport path R1.

In the present exemplary embodiment, a gap G is disposed between the upstream portion 48A of the opposing portion 48 and the pressing roller 46.

In other words, the upstream portion 48A of the opposing portion 48 is spaced apart from the pressing roller 46, so that a gap G is formed between the upstream portion 48A of the opposing portion 48 and the pressing roller 46.

In the present exemplary embodiment, the heat receiver 413 is disposed in the gap G.

The heat receiver 413 is disposed closer to the upstream portion 48A.

Specifically, the heat receiver 413 is fixed to the upstream portion 48A and located at a portion closer to the upstream portion 48A than the pressing roller 46. More specifically, the heat receiver 413 is in close contact with the upstream portion 48A.

The heat receiver 413 thus disposed closer to the upstream portion 48A allows the sheet P to more smoothly pass between the heat receiver 413 and the pressing roller 46 than in the case where the heat receiver 413 is disposed closer to the pressing roller 46.

The fixing device 40 according to the present exemplary embodiment heats (pre-heats) the sheet P in the gap G located upstream of the nip area N. Thereafter, the sheet P is pressed and heated in the nip area N.

Here, as in the present exemplary embodiment, the heat receiver 413 disposed opposite the pressing roller 46 across the sheet transport path R1 receives heat from the pressing roller 46.

Thus, in the present exemplary embodiment, the temperature in the gap G rises further than in the structure not including the heat receiver 413. Thus, the present exemplary embodiment enhances the efficiency of heating the sheet P passing through the fixing device 40.

Here, the heat receiver 413 is a member that is disposed at a portion at which heat dissipated from the pressing roller 46, which is a heat source, arrives to receive the dissipated heat.

The opposing portion 48 according to the present exemplary embodiment has an opposing surface 50, opposing the pressing roller 46. The opposing surface 50 includes a downstream opposing surface 51 and an upstream opposing surface 52.

The downstream opposing surface 51 is a portion of the surface of the downstream contact member 412A located closer to the pressing roller 46.

In the present exemplary embodiment, the pressed portion 49 is formed on the downstream opposing surface 51.

The downstream opposing surface 51 includes an upstream end portion 51A, upstream in the direction in which the sheet P moves, and a downstream end portion 51B, downstream in the direction in which the sheet P moves.

In the present exemplary embodiment, an upstream portion of the downstream opposing surface 51 in the direction in which the sheet P moves (portion located near the upstream end portion 51A) is spaced apart from the pressing roller 46.

In the present exemplary embodiment, the heat receiver 413 is fixed, by bonding, to the portion of the downstream opposing surface 51 apart from the pressing roller 46.

More specifically, the heat receiver 413 is fixed to the portion apart from the pressing roller 46 with a double-sided tape (not illustrated) disposed between the downstream opposing surface 51 and the heat receiver 413.

In the present exemplary embodiment, instead of the entire surface of an opposing portion 413X of the heat receiver 413 opposing the downstream opposing surface 51 being fixed to the downstream opposing surface 51, a downstream portion of the opposing portion 413X in the direction in which the sheet P moves is fixed to the downstream opposing surface 51.

In the present exemplary embodiment, a gap K is formed between the downstream opposing surface 51 and an upstream portion of the opposing portion 413X in the direction in which the sheet P moves.

The upstream opposing surface 52 is described now.

The upstream opposing surface 52 is located upstream of the downstream opposing surface 51 in the direction in which the sheet P moves. The upstream opposing surface 52 is disposed while having a gap W between itself and the downstream opposing surface 51.

The upstream opposing surface 52 includes an upstream end portion 52A, upstream in the direction in which the sheet P moves, and a downstream end portion 52B, downstream in the direction in which the sheet P moves.

In the present exemplary embodiment, an extended plane 51E of the downstream opposing surface 51 and an extended plane 52E of the upstream opposing surface 52 cross each other.

More specifically, the downstream opposing surface 51 and the upstream opposing surface 52 are disposed so that an angle α formed by the extended plane 51E of the downstream opposing surface 51 and the extended plane 52E of the upstream opposing surface 52 is an obtuse angle.

In the present exemplary embodiment, the upstream opposing surface 52 is located closer to the pressing roller 46 than the extended plane 51E of the downstream opposing surface 51 (the portion of the extended plane 51E indicated with reference sign 3X).

The heat receiver 413 is located at a portion at which the upstream opposing surface 52 and the downstream opposing surface 51 oppose each other.

Specifically, the heat receiver 413 is located at a portion opposing the upstream opposing surface 52 and extends downstream in the direction in which the sheet P moves from the opposing position.

The heat receiver 413 has a far end 413S in the longitudinal direction reaching a portion opposing the downstream opposing surface 51.

Specifically, the heat receiver 413 is disposed across a gap W between the upstream opposing surface 52 and the downstream opposing surface 51.

As in the case of the present exemplary embodiment, the heat receiver 413 extending from the upstream opposing surface 52 to the downstream opposing surface 51 is disposed across the gap W, so that heat is prevented from dissipating through the gap W.

As in the present exemplary embodiment, the heat receiver 413 disposed to oppose both of the upstream opposing surface 52 and the downstream opposing surface 51 further prevents heat in the gap G from dissipating out of the gap G than in the case where the heat receiver 413 opposes only one of the opposing surfaces.

The heat receiver 413 is fixed to the downstream opposing surface 51 by bonding.

More specifically, the heat receiver 413 is fixed to an upstream portion of the downstream opposing surface 51 in the direction in which the sheet P moves (fixed to a portion of the downstream opposing surface 51 adjacent to the upstream end portion 51A).

The heat receiver 413 is fixed to the downstream opposing surface 51, instead of both of the upstream opposing surface 52 and the downstream opposing surface 51. In other words, the heat receiver 413 is fixed to one of the upstream opposing surface 52 and the downstream opposing surface 51.

Specifically, in the present exemplary embodiment, the heat receiver 413 is fixed to a portion of the opposing surface 50, and the fixing device 40 according to the present exemplary embodiment has a portion to which the opposing surface 50 and the heat receiver 413 are not fixed.

More specifically, as described above, the heat receiver 413 is fixed to the downstream opposing surface 51 and not fixed to the upstream opposing surface 52.

Specifically, in the present exemplary embodiment, the heat receiver 413 has a downstream portion in the direction in which the sheet P moves fixed to the opposing surface 50, and an upstream portion in the direction in which the sheet P moves unfixed to the opposing surface 50.

To be more specific, in the present exemplary embodiment, the heat receiver 413 is fixed to the downstream opposing surface 51 at a portion denoted with reference sign 3A.

Specifically, the heat receiver 413 is fixed by bonding to the downstream opposing surface 51 at the portion denoted with reference sign 3A. More specifically, as described above, the heat receiver 413 is fixed to a portion of the downstream opposing surface 51 with a double-sided tape located between the downstream opposing surface 51 and the heat receiver 413.

In the present exemplary embodiment, the heat receiver 413 is urged toward (pressed against) the upstream opposing surface 52 with the elasticity of the heat receiver 413.

Specifically, in the present exemplary embodiment, the downstream end portion 413B of the heat receiver 413 is a fixed end, and the upstream end portion 413A of the heat receiver 413 is a free end. The free end (upstream end portion 413A) of the heat receiver 413 is urged toward the upstream opposing surface 52.

The present exemplary embodiment has described the case where a downstream portion of the heat receiver 413 (portion located downstream in the direction in which the sheet P moves) is fixed to the opposing surface 50. However, an upstream portion of the heat receiver 413 may be fixed to the opposing surface 50.

The heat receiver 413 having an upstream portion fixed to the opposing surface 50 is less likely to be deformed than in the heat receiver 413 having a downstream portion fixed to the opposing surface 50.

More specifically, in the present exemplary embodiment, the circularly moving fixing belt 410 (refer to FIG. 2) exerts the load in the direction of arrow 3B (refer to FIG. 3) on the heat receiver 413. This load may deform the heat receiver 413, for example, buckle the heat receiver 413.

To address this, an upstream portion of the heat receiver 413 is fixed to the opposing surface 50, and the free end portion of the heat receiver 413 is located downstream. Thus, the heat receiver 413 is less likely to be deformed.

As in the case of the present exemplary embodiment, at a portion at which the opposing surface 50 and the heat receiver 413 are not fixed to each other, the degree of adhesion between the opposing surface 50 and the heat receiver 413 decreases, and thus heat is less likely to be transmitted from the heat receiver 413 to the opposing surface 50.

Thus, heat of the heat receiver 413 is prevented from dissipating toward the opposing surface 50, so that the temperature in the gap G rises further.

In the present exemplary embodiment, in comparison of the area (fixed portion area) of the fixed portion (portion denoted with reference sign 3A in FIG. 3) of the heat receiver 413 that is fixed to the opposing surface 50 and the area of a portion (a portion upstream of the fixed portion, or an unfixed portion) of the heat receiver 413 that is not fixed to the opposing surface 50, the area of the unfixed portion is larger than the area of the fixed portion.

In this structure, the heat of the heat receiver 413 is prevented from dissipating to the opposing portion 48, so that the temperature in the gap G is further raised than in the case where the area of the unfixed portion is smaller than the area of the fixed portion.

Here, "fixing" of the heat receiver 413 to the opposing surface 50 is to fix the heat receiver 413 to the opposing surface 50 using a component other than the components of the opposing surface 50 and the heat receiver 413. In the present exemplary embodiment, the heat receiver 413 is fixed to the opposing surface 50 using an adhesive different from the opposing surface 50 and the heat receiver 413.

In the present exemplary embodiment, the heat receiver 413 is pressed against the upstream opposing surface 52, and the heat receiver 413 is temporarily fixed to the opposing surface 50 also at the opposing portion of the upstream opposing surface 52. However, this "fixing" does not involve the use of the above-described other component, and thus does not correspond to "fixing" in the present exemplary embodiment.

In the present exemplary embodiment, the heat receiver 413 is not disposed at the portion opposing the pressed portion 49 of the downstream opposing surface 51.

If disposed at the portion opposing the pressed portion 49, the heat receiver 413 may change the properties potentially obtained from the pressed portion 49 (such as pressing properties, heating properties, or sheet separation properties), and the properties may degrade or fail to be obtained.

Specifically, at the position at which the pressed portion 49 is disposed, the sheet P is pressed and heated, and the fixing belt 410 is bent (bent to protrude downward in the drawing) to facilitate separation of the sheet P from the fixing belt 410.

In this case, the heat receiver 413 disposed at the portion opposing the pressed portion 49 may degrade or fail to obtain these functions.

In the present exemplary embodiment, the heat receiver 413 is not disposed at the portion opposing the pressed portion 49 to prevent, for example, the properties or functions from being changed by the heat receiver 413.

In the present exemplary embodiment, a distance L1<a distance L2, where the distance between the far end 4135 of the heat receiver 413 and the upstream end portion 51A of the downstream opposing surface 51 is denoted with a distance L1, and the distance between the far end 4135 and the downstream end portion 51B of the downstream opposing surface 51 is denoted with a distance L2.

Thus, in the present exemplary embodiment, the heat receiver 413 is further spaced apart from the pressed portion 49 and the above-described changes of the properties or functions are less likely to occur than in the case where the distance L1>the distance L2.

Specifically, in the case where the distance L1>the distance L2, the heat receiver 413 is more likely to be disposed adjacent to the pressed portion 49. In this case, the properties or functions are more likely to be changed, as described above.

In contrast, in the case where the distance L1<distance L2, the heat receiver 413 is spaced apart from the pressed portion 49, so that the properties or functions are less likely to be changed.

More specifically, in the present exemplary embodiment, the far end 413S of the heat receiver 413 is located upstream of a middle point 51C of the downstream opposing surface 51. Thus, the properties or functions are less likely to be changed than in the case where the far end 413S of the heat receiver 413 is located downstream of the middle point 51C.

Here, the middle point 51C is a position between the upstream end portion 51A and the downstream end portion 51B of the downstream opposing surface 51, and the distance from the upstream end portion 51A to the middle point 51C over the downstream opposing surface 51 is equal to the distance from the downstream end portion 51B to the middle point 51C over the downstream opposing surface 51.

In the present exemplary embodiment, the heat receiver 413 is disposed to approach the pressing roller 46 as it extends downstream in the direction in which the sheet P moves.

Specifically, in the present exemplary embodiment, the downstream end portion 413B of the heat receiver 413 is disposed closer to the pressing roller 46 than is the upstream end portion 413A of the heat receiver 413.

The heat receiver 413 according to the present exemplary embodiment is formed of a resin-made plate, and extends along the sheet transport path R1. In addition, the heat receiver 413 is disposed to approach the pressing roller 46 as it extends downstream in the direction in which the sheet P moves.

Although the heat receiver 413 is formed of a plate in the present exemplary embodiment, the heat receiver 413 is not limited to this. The heat receiver 413 may be formed of a porous material such as polyurethane. Alternatively, the heat receiver 413 may have an uneven surface to form an air layer to enhance heat insulation.

As in the case of the present exemplary embodiment, the heat receiver 413 disposed to approach the pressing roller 46 as it extends downstream facilitates smooth transportation of the sheet P toward the nip area N compared to the case where the heat receiver 413 is not disposed to approach the pressing roller 46.

More specifically, in the case where the heat receiver 413 approaches the pressing roller 46 as it extends downstream, the fixing belt 410 passing by the portion opposing the heat receiver 413 gradually approaches the nip area N. In this case, the sheet P guided by the fixing belt 410 moves more smoothly toward the nip area N.

Figure 4A:
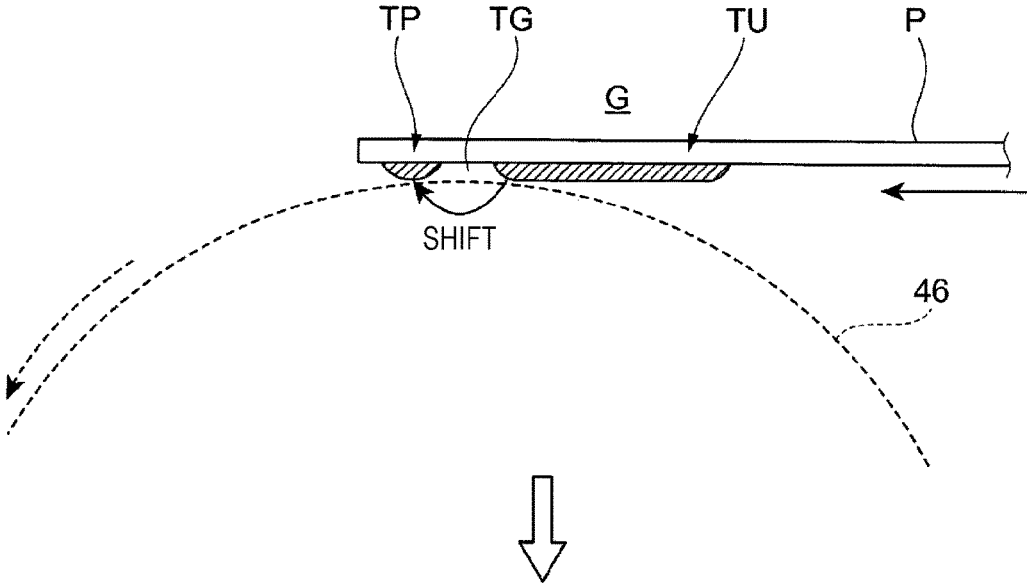
FIGS. 4A and 4B illustrate a sheet passing through a gap.
Figure 4B:
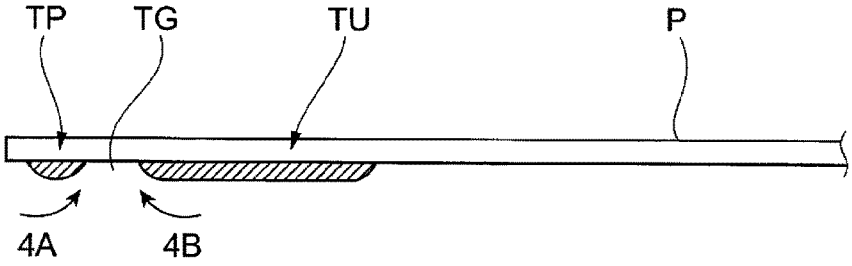

FIGS. 4A and 4B illustrate a sheet P passing through the gap G. FIGS. 4A and 4B omit illustrations of components including the fixing belt module 41 and the heat receiver 413.

The structure according to the present exemplary embodiment that enhances the efficiency of heating the sheet P prevents image degradation attributable to a shift of part of toner images.

In the structure according to the present exemplary embodiment, the sheet P and the pressing roller 46 are not in close contact with each other in the gap G. Thus, as illustrated in FIG. 4A, for example, part of a toner image TP may be shifted downstream as a result of the toner image on the sheet P being pressed by the pressing roller 46 moving faster than the sheet P.

In this case, a gap TG is formed between the shifted toner image TP and an upstream toner image TU, which is a toner image (original toner image to which the toner image TP has belonged) located upstream of the toner image TP. This gap TG may impair the appearance of the image formed on the sheet P.

In the structure where the heat receiver 413 is disposed and the atmosphere temperature in the gap G is high as in the case of the present exemplary embodiment, the toner image TP and the upstream toner image TU are more likely to melt, and thus the gap TG is more likely to be filled with toner.

Specifically, when the toner image TP or the upstream toner image TU is more likely to melt, when being pressed in the nip area N, these toner images are squashed and spread to the gap TG, as indicated with arrows 4A and 4B in FIG. 4B.

Thus, the gap TG is filled with toner, and becomes inconspicuous. The inconspicuous gap TG prevents reduction of the image quality attributable to the gap TG.

Figure 5:
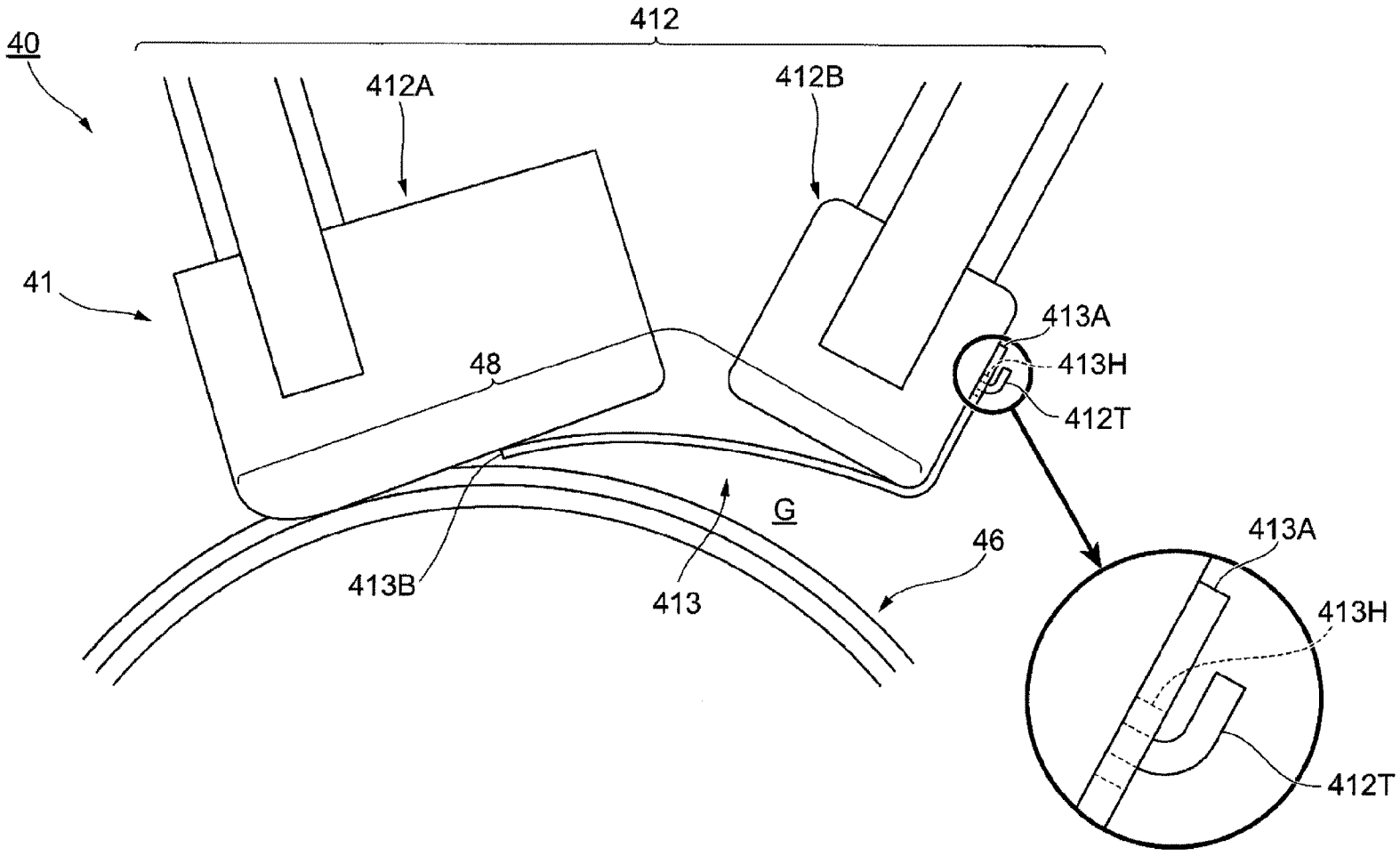
FIG. 5 illustrates another structure example of a fixing device.

FIG. 5 illustrates another structure example of the fixing device 40. FIG. 5 omits an illustration of the fixing belt 410.

In this structure example, the heat receiver 413 is fixed to a portion of the pressing unit 412 other than the opposing portion 48. Specifically, the heat receiver 413 is fixed to a portion upstream of the opposing portion 48 in the direction in which the fixing belt 410 (refer to FIG. 2) moves.

Specifically, this structure example includes a protrusion 412T at this upstream portion. This structure also includes a through hole 413H in the heat receiver 413 to allow the protrusion 412T to extend therethrough.

In this structure example, the heat receiver 413 is hooked on the protrusion 412T (the protrusion 412T extends through the through hole 413H) so that the heat receiver 413 is fixed to the pressing unit 412.

This structure example reduces heat dissipating from the heat receiver 413 to the opposing portion 48 and raises the temperature in the gap G further than in the structure in which the heat receiver 413 is fixed to the opposing portion 48.

Also in this structure example where the heat receiver 413 having a free end at the downstream end portion 413B is less likely to be deformed, such as buckled, than in the case where the heat receiver 413 has a free end at the upstream end portion 413A.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device, comprising:

a first pressing member that is heated and that presses a recording medium moving along a recording medium transport path;

a second pressing member that is disposed opposite the first pressing member across the recording medium transport path and presses the recording medium, the second pressing member including an opposing portion opposing the first pressing member, the opposing portion having, at a part, a pressed portion pressed against the first pressing member; and a heat receiver that is disposed to oppose an upstream portion of the opposing portion, the upstream portion of the opposing portion being located upstream of the pressed portion and upstream of a point where the fixing unit first presses the recording medium in a direction in which the recording medium moves, and configured to receive heat from the first pressing member.

2. The fixing device according to claim 1, wherein a gap is formed between the upstream portion of the opposing portion and the first pressing member, and wherein the heat receiver is disposed in the gap.

3. The fixing device according to claim 2, wherein the heat receiver is disposed in the gap at a portion adjacent to the upstream portion.

4. The fixing device according to claim 1, wherein an opposing surface of the opposing portion opposing the first pressing member includes a downstream opposing surface, disposed downstream in the direction in which the recording medium moves and including the pressed portion, and an upstream opposing surface, disposed upstream of the downstream opposing surface in the direction in which the recording medium moves with a gap between the upstream opposing surface and the downstream opposing surface, and wherein the heat receiver is located at at least a portion opposing the upstream opposing surface.

5. The fixing device according to claim 4, wherein the heat receiver is disposed to extend downstream in the direction in which the recording medium moves, the heat receiver having a far end in a longitudinal direction reaching a portion opposing the downstream opposing surface.

6. The fixing device according to claim 5, wherein the downstream opposing surface includes an upstream end portion, located upstream in the direction in which the recording medium moves, and a downstream end portion, located downstream in the direction in which the recording medium moves, and wherein a distance between the far end of the heat receiver and the upstream end portion of the downstream opposing surface is smaller than a distance between the far end and the downstream end portion of the downstream opposing surface.

7. The fixing device according to claim 1, wherein the heat receiver is not disposed at a portion opposing the pressed portion of the opposing portion.

8. The fixing device according to claim 1, wherein the heat receiver is disposed to approach the first pressing member as the heat receiver extends downstream in the direction in which the recording medium moves.

9. An image forming apparatus, comprising:

an image forming member that forms an image on a recording medium; and a fixing device that fixes the image formed on the recording medium by the image forming member onto the recording medium, wherein the fixing device is the fixing device according to claim 1.

10. A fixing device, comprising:

a first pressing member that is heated and that presses a recording medium moving along a recording medium transport path;

a second pressing member that is disposed opposite the first pressing member across the recording medium transport path and presses the recording medium, the second pressing member including an opposing portion opposing the first pressing member, the opposing portion having, at a part, a pressed portion pressed against the first pressing member; and a heat receiver that is disposed to oppose an upstream portion of the opposing portion, the upstream portion of the opposing portion being located upstream of the pressed portion in a direction in which the recording medium moves, and configured to receive heat from the first pressing member, wherein an opposing surface of the opposing portion opposing the first pressing member includes a downstream opposing surface, disposed downstream in the direction in which the recording medium moves and including the pressed portion, and an upstream opposing surface, disposed upstream of the downstream opposing surface in the direction in which the recording medium moves with a gap between the upstream opposing surface and the downstream opposing surface, wherein the heat receiver is located at at least a portion opposing the upstream opposing surface, wherein the heat receiver is disposed to extend downstream in the direction in which the recording medium moves, the heat receiver having a far end in a longitudinal direction reaching a portion opposing the downstream opposing surface, and wherein the heat receiver is fixed to the downstream opposing surface, and not fixed to the upstream opposing surface.

11. A fixing device, comprising:

first pressing means heated for pressing a recording medium moving along a recording medium transport path;

second pressing means disposed opposite the first pressing means across the recording medium transport path for pressing the recording medium, the second pressing means including an opposing portion opposing the first pressing means, the opposing portion having, at a part, a pressed portion pressed against the first pressing means; and heat receiving means disposed to oppose an upstream portion of the opposing portion, the upstream portion of the opposing portion being located upstream of the pressed portion and upstream of a point where the fixing unit first presses the recording medium in a direction in which the recording medium moves, the heat receiving means configured to receive heat from the first pressing means.

* * * * *